US005947112A

United States Patent [19]

Hawkinson

[11] Patent Number: 5,947,112

[45] Date of Patent: Sep. 7, 1999

[54] PREFABRICATED FIREPLACE EXHAUST PLENUM STRUCTURE

[75] Inventor: Eric Paul Hawkinson, Mount Pleasant, Iowa

[73] Assignee: Heat-N-Glo Fireplace Products, Inc, Lakeville, Minn.

[21] Appl. No.: 09/003,609

[22] Filed: Jan. 7, 1998

[51] Int. Cl.[6] ..... F24C 3/00

[52] U.S. Cl. ..... 126/512; 126/85 B; 126/523; 126/531; 431/125

[58] Field of Search ..... 126/512, 503, 126/92 R, 92 AC, 85 B, 531, 528, 523; 431/125

[56] References Cited

U.S. PATENT DOCUMENTS 2,225,203 12/1940 Barnes ..... 126/512
5,076,254 12/1991 Shimek et al. ..... 126/512
5,339,797 8/1994 Maitland ..... 126/312
5,603,312 2/1997 Champion ..... 126/85 B

*Primary Examiner*—James C. Yeung
*Attorney, Agent, or Firm*—John B. Sowell-ATY

[57] ABSTRACT

A novel wood/gas burning fireplace is provided with an open box shaped outer housing. A combustion chamber is mounted inside said housing having a plurality panels that are juxtaposed the panels of the outer housing so as to provide an open wall at the bottom, back and top of the fireplace which serve as a heat exchanger. An insulating panel is mounted in the top wall of the heat exchanger dividing the top wall into two separate passageways. The air passageway below the insulating panel comprises a part of a heat exchanger for heating room air of the space being heated. The air passageway above the insulating panel forms a plenum chamber with apertures in the outer housing panel(s) for conducting room air into the plenum chamber. A stack opening aperture in the top panel of the outer housing conducts cooling air into a coaxial exhaust stack for cooling the top panel as well as the exhaust stack pipe.

17 Claims, 2 Drawing Sheets

PREFABRICATED FIREPLACE EXHAUST PLENUM STRUCTURE

BACKGROUND OF THE INVENTION

1. Field of the Invention

The present invention relates to wood burning fireplaces. More particularly, the present invention relates to a novel stand off and improved top and exhaust structure for gas and wood burning fireplaces.

2. Description of the Prior Art

Heretofore exhaust stacks on stoves, fireplaces and gas water heaters have been known to overheat and create a hazardous condition that could result in igniting flammable walls and roof structures.

A common cure for a hot stack on a gas water heater is a well known vent collar which mixes room air with the exhaust gas to lower the stack temperature. Domestic boilers and furnaces have adapted the same principal as a vent collar by directing hot exhaust gases through a hood or plenum which pulls room air into a box shaped chamber and mixes it with room air. The cooled mixture is then directed into a conventional exhaust stack. The problem with vent collars and vent hoods is that they often require a large number of individual pieces that add to the stack cost.

Another remedy for a hot exhaust stack for fireplaces is to provide a coaxial or two piece exhaust stack which is mounted on and supported by the fireplace. As will be explained in greater detail hereinafter, the room air is pulled into the space between the larger diameter pipe and the smaller exhaust pipe to insulate or isolate the inner pipe which contains the hot exhaust gas. The outer pipe with an air space between it and the exhaust pipe forms an effective insulator. Prior art coaxial pipe stacks are known to be expensive and can be complex.

It would be desirable to provide in a wood or gas fireplace, an improved lightweight and low cost cooled exhaust stack and top support structure which would permit it to be directly coupled to a conventional coaxial exhaust stack without expensive insulating structures or vent collars.

SUMMARY OF THE INVENTION

It is a primary object of the present invention to provide a zero clearance wood burning fireplace capable of being installed in a walled enclosure or against an outside wall of a room or building to be heated.

It is another primary object of the present invention to provide a fireplace exhaust structure which is constructed with fewer parts, yet has an improved efficiency of operation.

It is another primary object of the present invention to provide a new top structure for a fireplace that eliminates the need for conventional standoff supporters, vents, collars and complex insulation.

It is a general object of the present invention to provide a novel prefabricated base model wood burning fireplace structure which may be completed upon installation in the field in the form of a radiant heater or with a circulating air heat exchanger.

It is a general object of the present invention to eliminate the need for radiation shields and top panel standoffs for a novel cooled fireplace.

It is another general object of the present invention to provide in a heat exchanger wall an insulating panel that divides the heat exchanger wall into two air passageways which provide cooling of the outer housing panels sufficient to employ the fireplace in a wood burning or a gas burning fireplace without modification.

According to these and other objects of the present invention, there is provided an outer housing and a combustion chamber mounted inside the outer housing having a plurality of similar juxtaposed panel which form walls having an airspace between similar panels. A heat exchanger is formed by the interconnection of the bottom back and top walls which warms the room air and cools the panels of the outer housing with the exception of the top panel of the outer housing which is separated from the heat exchanger by an insulation panel mounted in the top wall of the heat exchanger and forming a top air passageway above the insulating panel. Apertures are provided in the side panels of the outer housing for the entrance of room air into the top air passageway. The air entering the top air passageway is coupled into the outer pipe of a coaxial exhaust stack for cooling the top panel of the outer housing as well as insulating and cooling the hot exhaust stack in the center of the coaxial exhaust stack.

DESCRIPTION OF THE PREFERRED EMBODIMENTS

Figure 1:
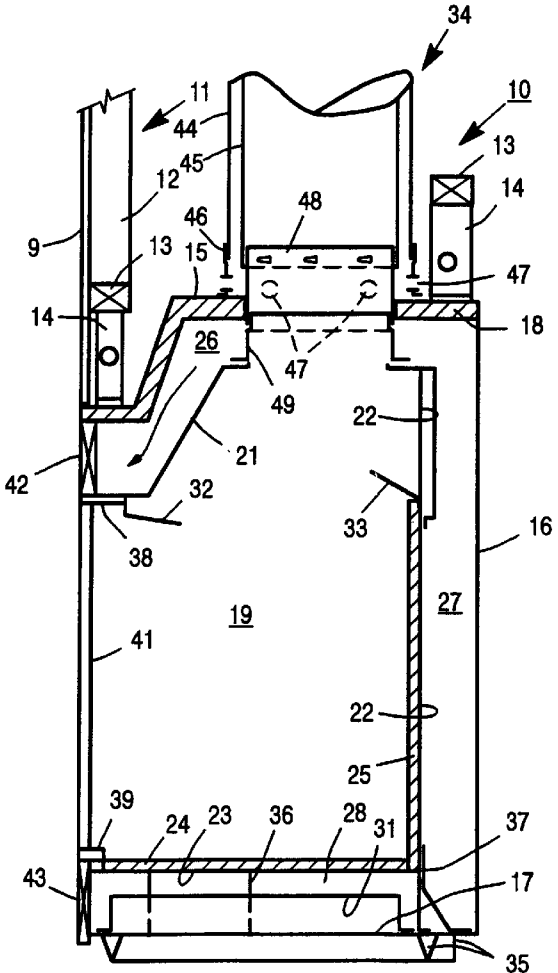
Figure 1 (Prior Art)
FIG. 1 is a schematic drawing in side elevation of a prior art wood burning fireplace showing at least one radiation shield.

Refer now to FIG. 1 showing a state of the art prior art prefabricated wood burning fireplace 10 of the type which may be enclosed behind a wall 11. The wall 11 is shown having vertical studs 12 and horizontal studs 13 which rest on or are attached to metal standoffs 14. Wallboard 9 is attached to the wood studs 12, 13 to complete the wall 11. The fireplace 10 comprises an open box of outer panels of which the top 15, back 16 and bottom panels 17 are shown. A layer of insulation 18 is attached to top panel 15 yet still requires standoffs 14 to prevent organic studs 12, 13 from being overheated.

A combustion chamber 19 is mounted inside of the outer panels forming the open box 10 and is spaced apart from the top, back and bottom panels 15–17 (and the side panels not numbered) forming an air space in the walls formed by the combustion chamber panels 21–23 juxtaposed panels 15–17. The bottom and back panels 23, 22 are lined with a refractory material 24, 25 of the type known and used in the wood burning fireplace art that meets underwriter's specifications and is impact resistant.

Walls 26, 27 and 28 are formed by juxtaposed panels 15 to 17 and 21 to 23 and are interconnected. In the FIG. 1 embodiment, a radiation shield 29 is formed behind back panel 22 in the very hot upper portion of combustion chamber 19. Similar shields may be provided around the side panels above the refractory insulation 25. A second radiation shield 31 is provided in bottom wall 28 and is preferably mounted on outer bottom panel 17, however, it could be inverted and mounted on panel 23. Baffles 32 and 33 are mounted at the front and back of top of the combustion chamber 19 to direct the hot exhaust gases of combustion into the exhaust stack 34.

The fireplace 10 is provided with short vee shaped legs 35 which attach to outer panel 17. Formed metal shapes like 36 and 37 are provided in the wall 28, 27 to support the combustion chamber 19 within the open box 10.

A header panel 38 and a foot panel 39 are extended across the top and bottom of the opening of the combustion chamber 19. Header panel provides support for a mesh screen 41 which is slidably opened to provide access to the wood burning combustion chamber 19.

Upper and lower closure panels 42 and 43 block the opening in walls 26 and 28 respectively, thus creating a dead air space in walls 26 to 28.

Refer now to exhaust stack 34 shown as a coaxial pipe having an outer insulating pipe 44 and an inner hot exhaust pipe 45, the outer pipe 44 is connected to top outer panel 15 via outer collar 46 which is provided with apertures 47 that conducts cooling air into the space between pipes 45 and 44. The inner pipe 45 is connected via inner collar 48 to an adapter collar 49 in turn connected to top panel 21 of combustion chamber 19. The pipes, collars and adapters are provided with male and female ends such as corrugations, intercepted screws or flanges as are well known in the fireplace art.

Figure 2:
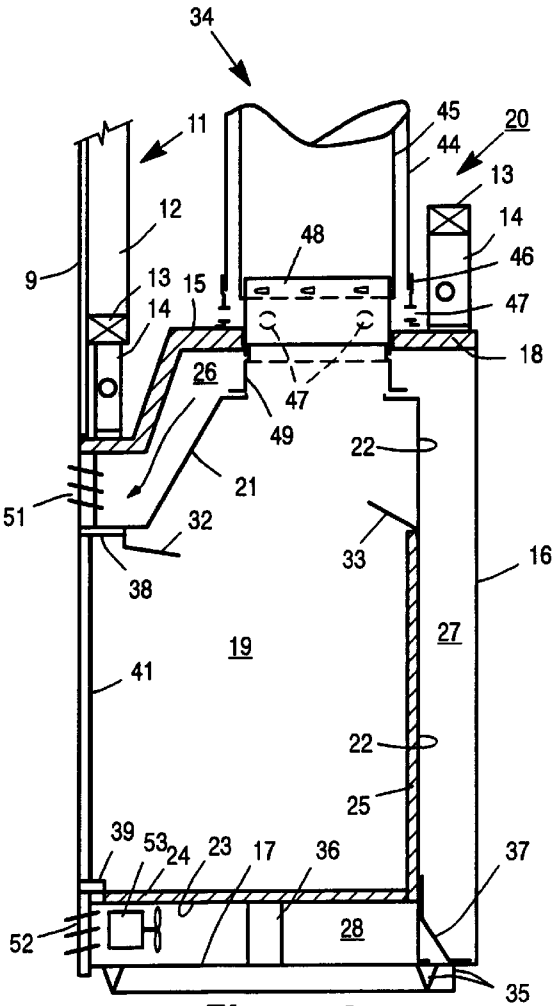
Figure 2 (Prior Art)
FIG. 2 is a schematic drawing in side elevation of a prior art wood burning fireplace showing a blower motor in the heat exchanger passageway which can be used to eliminate radiation shields.

Refer now to FIG. 2 showing a side elevation of a prior art wood burning fireplace 20 which is a modified version of fireplace 10 shown in FIG. 1. The numbered elements in FIG. 2 which are the same as those shown in FIG. 1 are numbered the same and have the same mode of operation.

In FIG. 2 the closure panels 42 and 43 are removed. Upper and lower grills 51 and 52 replace the closure panels 42 and 43, thus permitting room air to circulate through the heat exchanger formed by connected wall 26 to 28. A blower motor 53 is preferably employed in the bottom wall 28 to increase the efficiency of heat transfer and to permit the removal of radiation shields 29 and 31. Arrows show the direction of the air flow through the heat exchanger. Damper blades may be employed in the grills 51, 52 to direct air entry and exhaustion to and from the heat exchanger.

Figure 3:
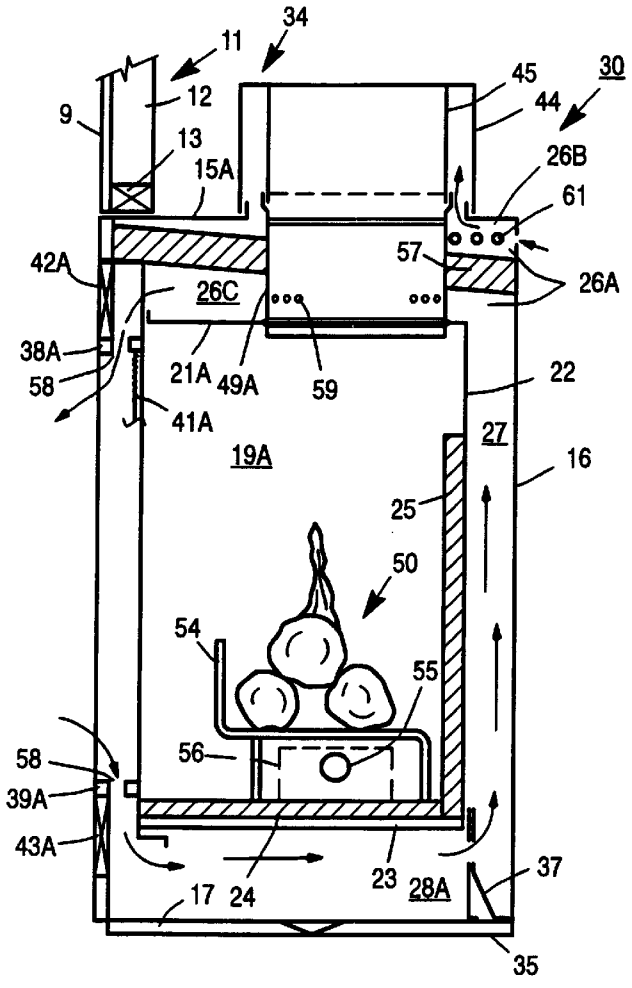
FIG. 3 is a schematic drawing in side elevation of the present invention fireplace designed for wood burning or conversion to gas burning showing the novel dual passageway top wall which eliminates radiation shields without a blower motor.

Refer now to FIG. 3 showing a schematic drawing in side elevation of a first preferred embodiment of the present invention. For purposes of explaining the novel improvement over the prior art FIGS. 1 and 2, a similar shaped open box housing 30 is shown even though the box can be made smaller so it will resemble a masonry fireplace as will be explained hereinafter.

A set of wooden logs or artificial logs 50 are shown supported on a grate 54. An opening 55 in the side of the combustion chamber provide an access for gas and/or combustion air which connects to a gas burner system 56 when converted to gas, otherwise the opening 55 remains closed by a knock out plug. It is possible to bring in both air and gas into the wall space 28A below the logs 50 and to provide holes in the refractory floor 24 as well as the bottom panel 23 of the combustion chamber 19A.

The front opening of the fireplace 30 is provided with upper and lower closure panels 42A and 43A which are preferably positioned above and below header panel 38A and foot panel 39A. The panels 38A and 39A and adapted to provide support for a fireplace mesh screen 41A (partially shown), or to permit mounting of a glass doors (not shown) especially when a gas burner conversion 56 is employed.

The top panel 15A of the outer housing is substantially flat and horizontal and is spaced apart from the top panel 21A of the combustion chamber forming a deep wall 26A. A thick semi rigid panel of insulating material 57 separates the wall 26A into and upper air passageway 26B and a lower air passageway 26C. The lower air passageway forms a part of a convection heat exchanger with walls 27 and 28. In the preferred embodiment slots and/or apertures 58 are provided in the header and foot panels 38A and 39A. It is also possible to modify the closure panels 42A and 43A to provide openings therein which enhance the flow of room air in the heat exchanger.

An exhaust stack adapter 49A is shown connected to top panel 21A. The connection provides a hot seal and prevents combustion gases from leaking into air passageway 26C and may be made from a single component. The adapter 49A is further provided with apertures 59 of a size, number and location that permits aspiration of room air in passageway 26C to be sucked into the adapter 49A as a result of the flow of exhaust gases from the combustion chamber 19A. A small amount of room air may be used to lower the slack temperature about five percent. A coaxial exhaust stack 34 comprising an outer insulating pipe 44 is connected to top panels 15A. The inner exhaust pipe 45 is connected to the adapter 49A. This arrangement can reduce the number of components in the exhaust stack from as many as six pieces down to two.

A feature of the present invention is that the panel of insulating material 57 is slightly compressible and when forced onto adapter 49A and the panels of the outer housing form gas and air tight joints. Bracket for positioning panel 57 may be attached to the housing panels and adhesive sealers may be employed but are not required, thus, reducing the cost of manufacturer.

The upper air passageway 26B is preferably provided with apertures 61 in the outer vertical panels of the housing. The apertures are of a size and number that provide adequate air in the insulating space between pipes 44 and 45 to meet underwriter's requirements for placement through or against organic structural members such as ceiling and roof structures. It will be understood that air passageway 26B acts as a cooling chamber for top panel 15A which is cooled sufficiently to eliminate standoffs 14 of the type used in the prior art.

The cooling effect provided by apertures 58 and the convection heat exchanger is sufficient to eliminate radiation panels 29 and 31 without any forced circulation of room air.

Figure 4:
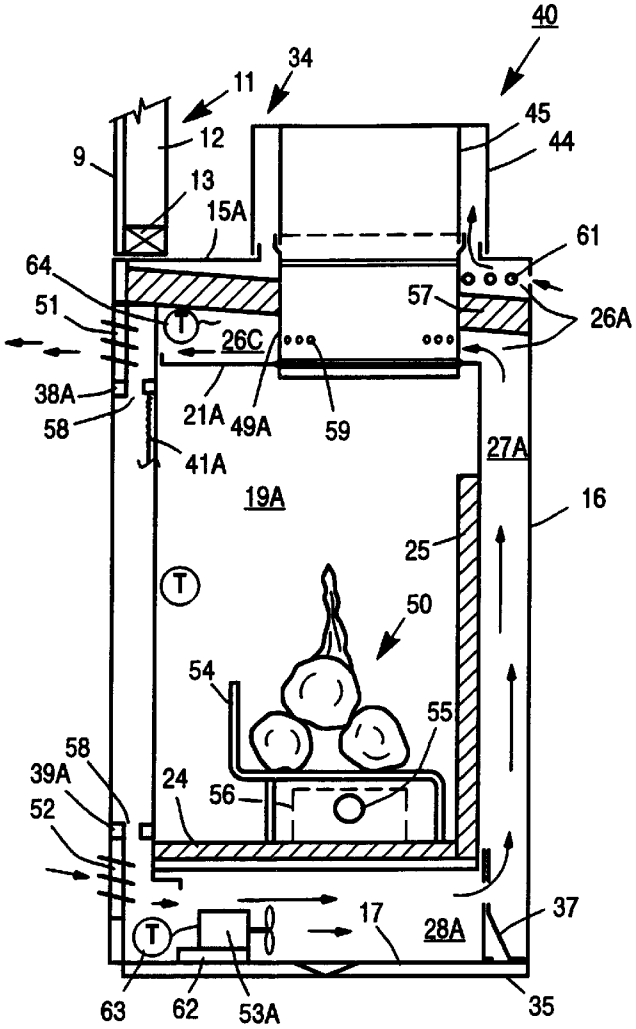
FIG. 4 is a schematic drawing in side elevation of the fireplace shown in FIG. 3 which now includes a high efficiency heat exchanger and controllable blower motor.

Refer now to FIG. 4 showing a schematic drawing of the fireplace 40 shown in FIG. 3 modified to include a high efficiency heat exchanger and controllable blower motor 53A. The numbered elements in FIG. 4 which are the same as those shown and described in FIG. 3 are numbered the same and do not require additional explanation.

In the modified preferred embodiment, motor 53A is provided with a source of power (not shown) which is controlled. The motor may be variable speed selectable by a controller 62 or switched on and off by a lower thermostat 63 and/or an upper thermostat 64 designed to prevent motor overheating and to permit the heat exchanger to warm up before withdrawing heat. In this embodiment the upper and lower closure panels 42A and 43A are replaced with grills 51 and 52 which preferably have directional vanes.

Having explained the present invention with reference to a wood burning fireplace, it will be understood that only one open box fireplace housing 30 and 40 needs to be prefabricated at the factory. The grills 51, 52 and closure panels 42, 43 are removable and replaceable in the factory or in the field. When gas conversion is desired or required a gas burner assembly and decorative doors may be added at the factory or during field installation. When a high efficiency heat exchanger is desired, a blower assembly 53, 62 etc. may be added in wall 28A by removal of the lower closure panel 43A and/or grill 52. In the preferred embodiment, slots 58 may be left open or covered by a dress plate (not shown).

Having explained a preferred embodiment and modifications thereof, it will be appreciated that not every fireplace will be fitted with all of the features explained, but certain combinations of individual features may be selected for solving different problems. In the preferred embodiments, the structure in the novel wall 26A simplifies the exhaust adapter structure as well as cooling top panel 15A and exhaust stack 34 which does not require a vent collar. Radiation shields are eliminated without the need of a blower motor which permits the fireplace to be made smaller and more efficient. Since the top and exhaust stack of the fireplace is made cooler, typical top and stack temperature encountered in the prior art of up to 900–1000° F. are easily reduced to where the fireplace is directly mountable against walls or enclosure structure and meet underwriter's specification for heat and safety without standoffs.

What is claimed is:

1. A wood/gas burning fireplace, comprising:

an outer metal housing, said housing having a first plurality of metal panels including a top panel connected to form an open box shape fireplace, a combustion chamber mounted inside said housing having a second plurality of similar panels spaced apart from said outer metal housing panels and having an air space connecting walls forming a heat exchanger between said first and second plurality of panels, an insulating panel mounted inside the top wall for dividing the air space in the top wall above the combustion chamber into two separated air passageways, the air passageway below said insulating panel in said top wall comprising a passageway of the heat exchanger for heating room air, the air passageway above said insulating panel in said top wall comprising a cooling plenum for conducting outside air through said passageway and into an outer pipe of coaxial exhaust pipe and for cooling the panel on top of said outer metal housing as well as the exhaust pipe, and an exhaust stack adapter coupled to said combustion chamber for conducting products of combustion from said fireplace into an exhaust pipe.

2. A fireplace as set forth in claim 1 wherein said the air passageway above said insulating panels further includes apertures in at least one of said outer metal panels of said housing for conducting air from outside the housing into the air passageway above said insulating panel which forms said cooling plenum.

3. A fireplace as set forth in claim 2 wherein said apertures in said outer housing panel introduce air in the air passageway above the insulating panel sufficient to cool the top panel of the outer housing for eliminating the need for standoffs on the top panel.

4. A fireplace as set forth in claim 2 wherein the number and size of said apertures are sufficient to reduce the top outer housing panel temperature to approximately 90° F. above room ambient temperature.

5. A fireplace as set forth in claim 1 wherein the center pipe of a coaxial exhaust pipe is coupled to said exhaust stack adapter which extends through the top housing panel, the insulating panel and the top panel of said combustion chamber.

6. A fireplace as set forth in claim 4 wherein a portion of said exhaust stack adapter in said air passageway below said insulating panel further includes apertures in said exhaust stack adapter for conducting air from the heat exchanger air passageway into said exhaust pipe.

7. A fireplace as set forth in claim 6 wherein the number and size of said apertures in said exhaust stack adapter are sufficient to lower the exhaust stack temperature to a predetermined maximum temperature below 750° F.

8. A fireplace as set forth in claim 6 wherein said apertures in said exhaust stack adapter are of a size to enhance aspiration of room air into said exhaust adapter.

9. A fireplace as set forth in claim 8 wherein said apertures in said exhaust stack adapter aspirates a predetermined percentage of room air into the exhaust gas.

10. A fireplace as set forth in claim 1 wherein said insulating panel in said top wall is substantially rigid yet compressible enough to be compression fitted against the vertical panels of said outer housing to form an edge seal.

11. A fireplace as set forth in claim 10 wherein said insulating panel is further compression sealed against said exhaust stack adapter.

12. A fireplace as set forth in claim 1 wherein said air space within the walls between said first and second plurality of panels are interconnected and form a heat exchanger around at least the bottom, back and top of said combustion chamber, a header panel at the upper front opening of said fireplace at said top wall, a foot panel at the lower front opening of said fireplace at said bottom wall, and apertures in said header panel and in said foot panel for circulating room air into and through said heat exchanger by natural convection.

13. A fireplace as set forth in claim 12 which further includes:

an upper grill forming an opening connecting into the top wall of said heat exchanger above the combustion chamber, a lower grill forming an opening connecting into the bottom wall of said heat exchanger below the combustion chamber, and a blower motor mounted in the bottom wall of said heat exchanger below said combustion chamber for circulating room air around the bottom, back and top of said combustion chamber.

14. A fireplace as set forth in claim 12 wherein said apertures in said header panel and in said foot panel are of a number and a size such that the housing panels are cooled sufficiently to eliminate the need for radiation insulation shields in the heat exchanger.

15. A method of eliminating radiation panels and standoffs in a fireplace, providing an outer metal housing for a direct vent fireplace, mounting a fireplace combustion chamber inside said housing with an air space between similar juxtaposed panels of the housing and the combustion chamber to form walls therebetween, mounting a panel of substantially rigid insulation in a top wall formed by said juxtaposed panels for providing an air passageway above and below said insulating panel in said top wall, forming a heat exchanger in the walls around the combustion chamber which includes the air passageway below said insulating panel for cooling the outer housing panels of said fireplace and to eliminate the need for radiation shields, forming openings in the outer housing panel connected to the air passageway above said insulating panel for cooling the top panel of said outer housing and for eliminating the need for standoffs on said top panel, and providing an exhaust stack adapter coupled to said combustion chamber for conducting products of combustion to an exhaust pipe.

16. The method as set forth in claim 15 which further includes:

extending said exhaust pipe adapter through said panel of rigid insulation above the top outer panel of said housing, and circulating room air from the air passageway above said insulating panel around the outside of said exhaust pipe adapter and into the air space between pipes of a coaxial exhaust pipe for cooling the exhaust pipe.

17. The method as set forth in claim 16 which further includes:

providing apertures in said exhaust pipe adapter inside of said air passageway below said insulating panel, for further cooling said exhaust pipe with room air mixed with the exhaust gas.

* * * * *